United States Patent [19]

Ohnishi

[11] 4,197,882

[45] Apr. 15, 1980

[54] FLUID JET SHUTTLELESS LOOM WITH RESISTANCE PROVIDING MEANS FOR WEFT YARN

[75] Inventor: Kimimasa Ohnishi, Tokyo, Japan

[73] Assignee: Nissan Motor Company, Limited, Japan

[21] Appl. No.: 932,564

[22] Filed: Aug. 10, 1978

[30] Foreign Application Priority Data

Aug. 18, 1977 [JP] Japan ..... 52-98287
Aug. 10, 1978 [CS] Czechoslovakia ..... 151289/78

[51] Int. Cl.[2] ..... D03D 47/29; D03D 47/34
[52] U.S. Cl. ..... 139/435; 139/452
[58] Field of Search ..... 139/435, 452, 450; 226/97, 117, 118, 119; 66/132 R

[56] References Cited

U.S. PATENT DOCUMENTS

| | | | |
|---|---|---|---|
| 3,233,634 | 2/1966 | Kobayashi | 139/435 |
| 3,444,900 | 5/1969 | Schaffer | 139/452 |
| 3,799,211 | 3/1974 | Klinecky et al. | 139/452 |
| 3,865,149 | 2/1975 | Kledany | 139/452 |

*Primary Examiner*—Henry Jaudon
*Attorney, Agent, or Firm*—Robert E. Burns; Emmanuel J. Lobato; Bruce L. Adams

[57] ABSTRACT

A fluid jet shuttleless loom is equipped with a device for providing the moving resistance due to sliding friction, to the weft yarn drawn out of a detaining device prior to projection from the nozzle of a yarn projecting unit. The moving resistance providing device is formed so that the resistance increases with progress of the projection step during which the weft yarn is projected from the nozzle into the shed of the warp yarns.

19 Claims, 21 Drawing Figures

FLUID JET SHUTTLELESS LOOM WITH RESISTANCE PROVIDING MEANS FOR WEFT YARN

BACKGROUND OF THE INVENTION

This invention relates to a fluid jet shuttleless loom, and more particularly to the shuttleless loom provided with a device for softening sudden change in tension applied to a weft yarn drawn out of a detaining device of the shuttleless loom.

SUMMARY OF THE INVENTION

It is the main object of the present invention to provide an improved fluid jet shuttleless loom, by which a weft yarn can be prevented from being cut and additionally filaments constituting the weft yarn is prevented from cracking, securely achieving the operation of the projection of the weft yarn into the shed of the warp yarns without causing the projected weft yarn to be caught by warp yarns.

Another object of the present invention is to provide an improved fluid jet shuttleless loom, by which the weft yarn before projection can be prevented from sudden change and the weft yarn can advance straightly and stably into the shed of the warp yarns.

A further object of the present invention is to provide an improved fluid jet shuttleless loom which is equipped with resistance providing means for providing the moving resistance due to sliding friction, to the weft yarn between a detaining device and guide means for guiding the weft yarn to a grasping device of the shuttleless loom.

A still further object of the present invention is to provide an improved fluid jet shuttleless loom which is equipped with resistance providing means for providing the moving resistance to the weft yarn before projection so that the moving resistance increses with progress of a projection step at which the weft yarn is projected from a yarn projecting unit into the shed of the warp yarns.

BRIEF DESCRIPTION OF THE DRAWINGS

Other objects, features and advantages of the fluid jet shuttleless loom in accordance with the present invention will be more apparent from the following description taken in conjunction with the accompanying drawings, in which.

DESCRIPTION OF THE PREFERRED EMBODIMENTS

Figure 1:
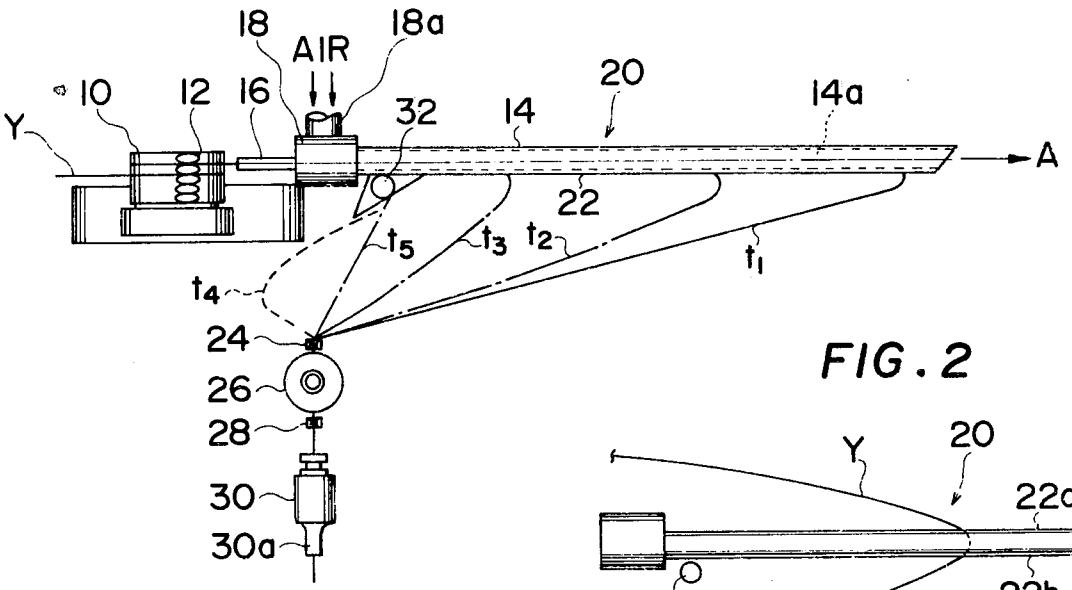
FIG. 1 is a schematic plan view of the essential part of an already proposed fluid jet shuttleless loom.

Referring to FIG. 1 of the drawings, there is illustrated an example of an essential part of an already proposed fluid jet shuttleless loom, through which part a weft yarn Y is projected to the shed of warp yarns (not shown). In such a fluid jet shuttleless loom, the weft yarn Y is passed a plurality of times around both a measuring roller 10 and a guide roller 12 to continuously measure a length of the weft yarn required for one projection of the weft yarn. The weft yarn Y is guided and introduced into a detaining chamber 14*a* formed in a tubular member 14 through a pipe 16 secured to a base member 18 of a detaining device 20 which functions to detain a length of the weft yarn Y prior to the projection of the weft yarn Y. The tubular member 14 is secured to the base member 18 which is formed therein with an opening (not shown) through which the detaining chambers 14*a* fluidly connects to the inside of the pipe 16. Air is supplied to the detaining chamber 14*a* through an inlet pipe 18*a* communicated to the opening formed in the base member 18 in order to generate an air stream in a direction of an arrow A in the detaining chamber 14*a*.

Accordingly, the weft yarn Y is floated in the detaining chamber 14*a* by the action of the air stream in the detaining chamber 14*a*. Then, the weft yarn Y is turned back and drawn out of the detaining chamber 14*a* through an elongate slit 22 which is formed along the length of the tubular member 14 so that the weft yarn Y is formed generally into a V-shape as indicated by $t_1$. Thereafter, the weft yarn Y is passed through a guide means 24 to a grasping device 26 for suitably repeating the operation of grasping and releasing the weft yarn. The weft yarn Y is guided through a guide means 28 into a yarn projecting unit 30 having a nozzle 30*a* for projecting the weft yarn Y into the shed of the warp yarns. The reference numeral 32 represents a stop formed across the slit 22 to stop the movement of the weft yarn in the states indicated by $t_4$ and $t_5$. When the time for projecting the weft yarn Y comes, i.e., the projection step of the weft yarn begins, the grasping device 26 releases the weft yarn Y immediately after water or air is injected through the nozzle 30*a* of the yarn projecting unit 30. Then, the weft yarn Y is projected from the nozzle 30*a* into the shed of the warp yarns, being drawn out of the detaining device 20. When projection of the weft yarn is finished, the grasping device 26 grasps the weft yarn Y, and the weft yarn Y delivered continuously from the measuring roller 10 is floated in the air stream generated in the detaining device 20 to wait for the next time projection of the weft yarn Y, maintaining the weft yarn Y generally in the V-shape between the detaining device 20 and the guide means 24.

The length of the weft yarn Y detaining in the detaining device 20 until the next time projection is set, for example, at about two-third the length required for one projection. Of course, this length of the weft yarn Y is different with the operation speeds of the fluid jet shuttleless loom. Hence, after initiation of the weft yarn projection, weft yarn Y is drawn out of the detaining device 20 at a high speed, being supplied to the detaining device 20 at a relatively low speed. This causes the stock amount of the weft yarn Y to decrease in the detaining device 20, changing the state of the weft yarn Y from one indicated by $t_1$ to one indicated by $t_5$. In the state of $t_5$ the weft yarn Y is stretched in a straight line between the stop 32 and the guide means 24. The flight of the weft yarn Y until this time is referred to as "free flight". After the "free flight" is finished, the weft yarn Y from the measuring roller 10 reaches to the nozzles 30*a* of the yarn projecting unit 30 merely passing through the tubular member 14 of the detaining device 20 without detaining in the detaining chamber 14*a* of the tubular member 14. Then, the weft yarn Y is projected from the nozzle 30*a* into the shed of the warp yarns. The flight of the weft yarn Y at this time is referred to as "measured flight". Accordingly, the projection step of the weft yarn consists of "free flight" period and "measured flight" period of the projected weft yarn. Of course, the "measured flight" period follows the "free flight" period. It is to be noted that during the "measured flight" period, the moving speed of the weft yarn Y becomes equal to the measuring speed of the measuring roller 10. As a result, the speed of the weft yarn passing through the nozzle 30*a* can be decreased and therefore the weft yarn Y is prevented from meandering during the projection of the weft yarn Y into the shed of the warp yarns.

Figure 4:
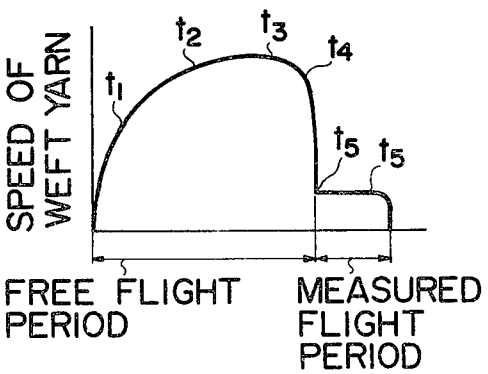
FIG. 4 is a graph showing the characteristics of the speed of the weft yarn passing through the nozzle of a yarn projecting unit of the loom of FIG. 1.

The moment the "free flight" period changes into the "measured flight" period, the speed of the weft yarn Y passing through the nozzle 30*a* is suddenly lowered as clearly shown in FIG. 4 in which the parts of a curve indicated by $t_1$ to $t_5$ correspond to the speed of the weft yarn at the states indicated by $t_1$ to $t_5$ in FIG. 1, respectively. At this moment, the weft yarn Y is stretched between the stop 32 and the guide means 24 indicated by $t_5$ in FIG. 1. In addition to the above, the weft yarn Y is curved as in the state indicated by $t_4$ in FIG. 1 by the action of the inertia of the weft yarn Y moved from the state of $t_1$ to the state of $t_5$. As a result, the tension applied to the weft yarn Y suddenly increases and therefore the weft yarn Y is liable to be cut and to cause the filaments constituting the weft yarn to crack. Moreover, in case of an air jet shuttleless loom, the thus sudden lowering of the speed of the yarn passing through the nozzle 30*a* leads to the disadvantage that the leading end of the weft yarn Y advancing in the shed of the warp yarns is shaken to deteriorate the flight posture of the weft yarn Y.

Figure 2:
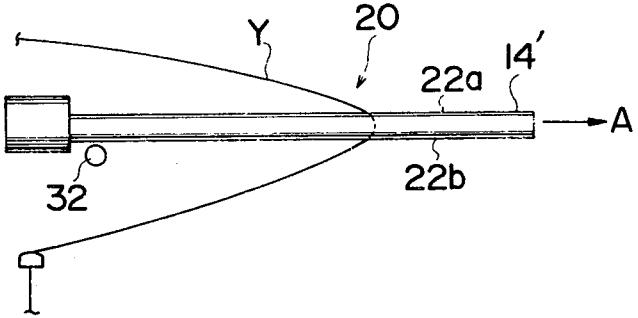
FIG. 2 is a schematic plan view of a detaining device of another already proposed fluid jet shuttleless loom.
Figure 3:
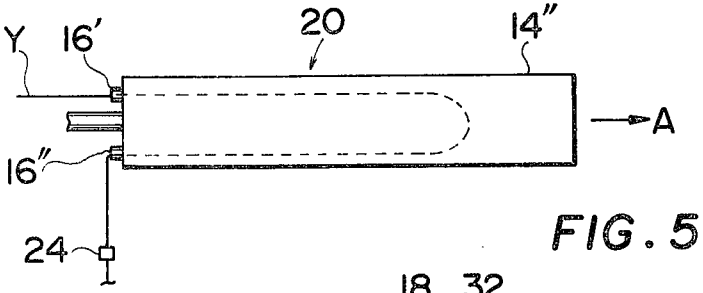
FIG. 3 is a schematic plan view of a detaining device of a further already proposed fluid jet shuttleless loom.

The above-mentioned disadvantages are also encountered in case in which an already proposed detaining device shown in FIG. 2 or 3 is used in the fluid jet shuttleless loom. In FIGS. 2 and 3, the same reference numerals as in FIG. 1 designate the same parts and elements.

The detaining device shown in FIG. 2 is composed of a tubular member 14' which is formed with two opposite slits 22*a* and 22*b*. With this detaining device 20, the weft yarn Y from the measuring roller (not shown) is passed through both the slits 22*a* and 22*b* and detained generally in a V-shape by virtue of air stream in a direction of the arrow A. During the "measured flight", the weft yarn Y is put into the state in which it stretches between the top 32 and the guide means 24. Hence, the tension applied to the weft yarn Y suddenly increase at the moment the "free flight" is changed into "the measured flight".

The detaining device 20 shown in FIG. 3 is composed of a flat tubular member 14''. With this detaining device 20, the weft yarn Y from the measuring roller (not shown) is passed from an inlet 16' through the inside of the tubular member 14'' to an outlet 16''. The weft yarn Y in the tubular member 14'' is floated in air stream in the direction of the arrow A to detain the weft yarn Y generally in a U-shape. Also in this case, during the "measured flight" period, the weft yarn Y is put into the state in which it stretches along the shortest distance between the inlet 16' and the outlet 16''. It will be understood also in this case, that a large amount of tension is suddenly applied to the weft yarn Y at the moment the "free flight" is changed into the "measured flight".

In view of the above, the present invention contemplates to overcome the above-mentioned disadvantages encounted in the already proposed fluid jet shuttleless looms using various types of detaining devices, by preventing the speed of the weft yarn passing through the nozzle of the yarn projecting unit to suddenly decrease at the moment the "free flight" period is changed into the "measured flight" period.

The present invention will now be explained with reference to FIGS. 5 to 21 in which the same reference numerals and terms as in FIG. 1 designate the same parts and matters, respectively, for the purpose of simplicity of illustration.

Figure 5:
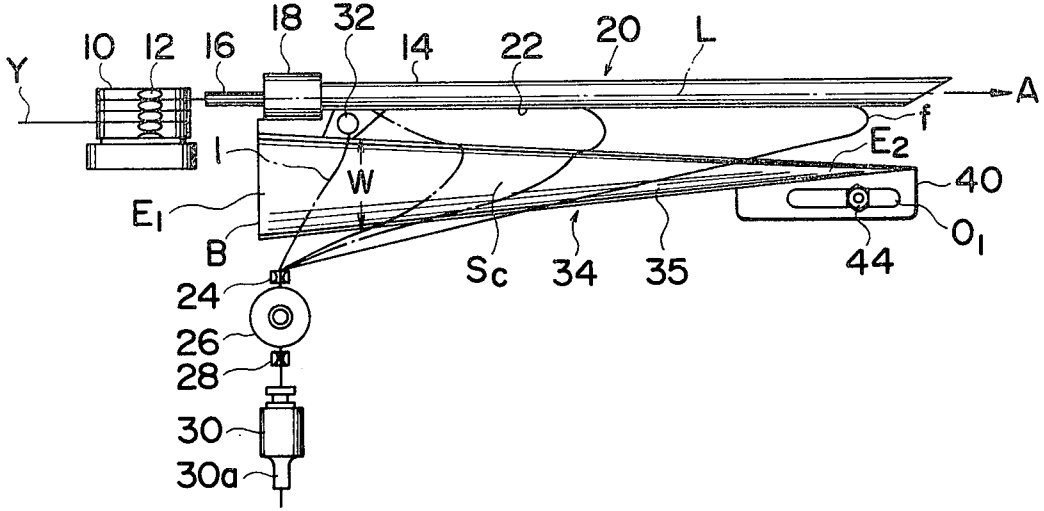
FIG. 5 is a schematic plan view of the essential part of a preferred embodiment of a fluid jet shuttleless loom in accordance with the present invention.
Figure 6:
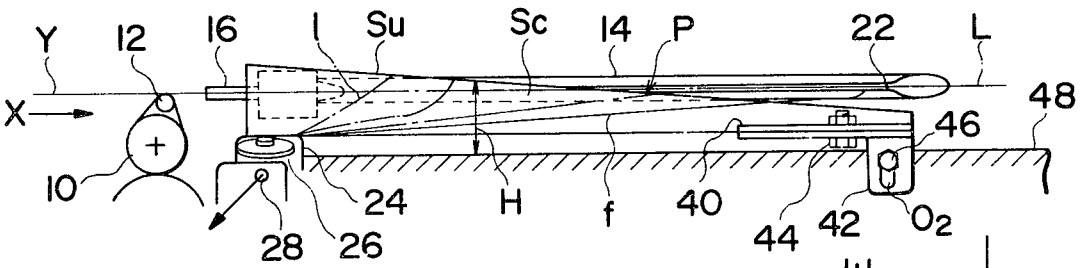
FIG. 6 is a schematic elevational view of the essential part of the loom of FIG. 5.
Figure 8:
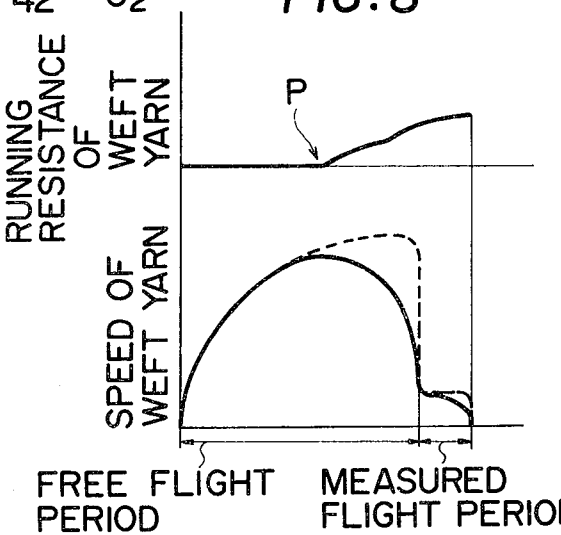
FIG. 8 is a graph showing the characteristics of a weft yarn in the loom of FIG. 5, in which the running resistance applied to the weft yarn by the action of resistance providing means is shown in the upper graph of FIG. 8 and the speed of the weft yarn passing through the nozzle of a yarn projecting unit is shown in the lower graph of FIG. 8.
Figure 7:
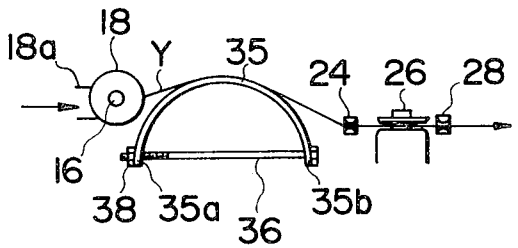
FIG. 7 is a side elevation view from a direction of an arrow X of FIG. 6.

Referring now to FIGS. 5, 6 and 7, an essential part of a preferred embodiment of a fluid jet shuttleless loom according to the present invention is shown including a resistance providing means 34 for providing a resistance due to sliding friction, to the weft yarn between the stop 32 and the guide means 24. The resistance providing means 34 comprises an elongate resistance providing member 35 which is located between and spaced apart from the tubular member 14. The member 35 is generally formed into a shape which will be formed by cutting a hollow cone or hollow conical member into two portions along its center axis. Accordingly, the member 35 is in the shape of a triangle in plan as shown in FIG. 5, the base B of the triangle being adjacent the base member 18 of the detaining device 20. A first end portion $E_1$ of the member 35 corresponding to the base B of the triangle is formed into the shape of an arc in cross-section as shown in FIG. 7. The longitudinal axis (not shown) of the member 35 is generally arranged parallel with the longitudinal axis L of the tubular member 14 of the detaining device 20. The member 35 is formed with an elongate curved surface $S_c$ whose longitudinal axis (not shown) is generally parallel with the longitudinal axis L of the tubular member 14. Such a shape of the member 35 is made, for example, by bending bendable plate member using a bolt 36 and a nut 38 incorporated with the bolt 36 in a manner shown in FIG. 7 in which the bolts 36 passes through the both side edge portions 35*a* and 35*b* of the bendable plate member. The member 35 is equipped with a bracket 40 secured to a second end portion $E_2$ thereof which end portion $E_2$ is far from the base member 18 of the detaining device 20 as compared with the first end portion $E_1$ thereof. The bracket 40 is secured to another bracket 42 with a bolt 44. The bracket 40 is, in turn, secured, with a bolt 46, to the body or flame 48 of the suttleless loom. Accordingly, the location of the member 34 is adjustable by changing the locations of the bolts 44 and 46 in openings $O_1$ and $O_2$, respectively.

As will be seen from Figures, on the curved surface $S_c$ of the resistance providing member 35, the weft yarn Y between the detaining device 20 and the guide means 24 slidingly moves from its state indicated by f to its state indicated by l, receiving the resistance due to sliding friction generated between it and the curved surface $S_c$. It is to be noted that the resistance due to the sliding friction between the sliding weft yarn Y and the curved surface $S_c$ gradually increases as the sliding weft yarn Y moves from the state of f to the state of l, i.e., the projection step of the weft yarn Y progresses from its initiation toward its termination, since the height H of the upper surface Su (shown in FIG. 6) of the member 34 relative to the upper surface 48*a* of the flame 48 increases as the weft yarn Y slidably moves from the state of f to the state of l. The upper surface of the flame 48 is substantially parallel to the longitudinal axis L of the tubular member 14 of the detaining device 20. As seen from FIG. 6, the contact between the weft yarn Y and the curved surface $S_c$ of the member 34 begins at a point P which lies in a plane (not identified) lying in the slit 22 of the tubular member 14, the plane being parallel to the upper surface 48*a* of the flame 48. As shown in FIG. 6, the slit 22 of this instance is formed along the longitudinal axis L of the tubular member 14 and faces to the resistance providing member 35. It will be seen that as the upper surface $S_u$ of the member 35 approaches to the first end portion $E_1$, the upper surface $S_u$ becomes higher from the point P gradually increasing length of the weft yarn contacted on the curved surface $S_c$ of the resistance providing member 35.

With the such arranged fluid jet shuttleless loom, when the weft yarn Y reaches to the point P shown in FIG. 6 during the "free flight" period, it begins to slidingly contact the curved surface $S_c$ of the resistance providing member 35. Accordingly, the running resistance of the weft yarn Y gradually increase as shown in an upper graph of FIG. 8 from the point P on the upper surface of the member 35, since the contacting pressure and the contacting length of the weft yarn on the surface $S_c$ are both increase due to increase of both the height H and the width W of the resistance providing member 35. This causes the speed of the weft yarn passing through the nozzle 30*a* to gradually decrease toward the termination of the "free flight" period as shown in a lower graph of FIG. 8 in which a dotted curve indicates the speed in the case of the arrangement of FIG. 1.

Therefore, the speed of the weft yarn Y passing through the nozzle 30*a* is prevented from its sudden decrease to prevent sudden increase in the tension applied to the weft yarn Y. Additionally, the weft yarn Y is prevented from being put into the state indicated by $t_4$ in FIG. 1, since the inertia of the moving weft yarn Y is suppressed by the slidable contact of the moving weft yarn to the curved surface $S_c$ of the resistance providing member 35. These greatly contributes to prevention of cutting of the weft yarn and cracking of the filaments constituting the weft yarn during the projection of the weft yarn Y from the nozzle 30*a* toward the shed of the warp yarns. It will be understood that meandering of the advancing weft yarn Y during the projection step is effectively prevented. Furthermore, even if the shuttleless loom is of the type using air jet to project the weft yarn, the above-mentioned gradual decrease of the advancing speed of the weft yarn prevents the shaking of the leading end of the advancing weft yarn during the projection step to improve the flight posture of the weft yarn Y.

It will be appreciated from the foregoing, that by selecting the location of the resistance providing member 35, it is possible to control or change the characteristics of the moving resistance provided to the weft yarn and the location of the point P at which the slidable contact between the weft yarn and the curved surface $S_c$ of the member 35 begins.

When a projection of the weft yarn Y into the shed of the warp yarns Y is completed, the weft yarn Y is grasped by the grasping device 26 to stop supply of the weft yarn to the yarn projection unit 30. Then, the weft yarn Y for the next projection is measured and prepared by the measuring roller 10 to supply it to the detaining device 20. The weft yarn supplied to the detaining device 20 is slidably moved on the curved surface $S_c$ of the resistance providing member 35 in the direction of the arrow A shown in FIG. 5. Thereafter, the weft yarn Y is detained and maintained in the state indicated by f in FIG. 5 to wait the next time projection of the weft yarn Y.

FIGS. 9 to 12 illustrates an essential part of another preferred embodiment of the fluid jet shuttleless loom in accordance with the present invention. The resistance providing member 35 of this embodiment is similar to that of FIG. 5 except for its shape in which the first end portion $E_1$ of the member 35 adjacent to the base member 18 decreases in width W, in plan, and in height H relative to the upper surface 48*a* of the body 48 as it approaches the first end portion $E_1$. Of course, the resistance providing member 35 increases both in its width W, in plan, and its height H relative to the surface 48*a* like in the embodiment of FIG. 5 from the second end portion $E_2$ to a highest portion $P_h$. Hence, the moving resistance applied to the weft yarn is gradually increased from the point P at which the weft yarn Y begins to slidingly contact with the curved surface $S_c$ of the member 34 during the "free flight" period of the weft yarn Y. However, the moving resistance is gradually decreased after the weft yarn Y sliding on the curved surface $S_c$ exceeds the portion $P_h$.

With the such arrangement, the speed of the weft yarn Y passing through the nozzle 30*a* gradually decreases when the weft yarn Y sliding on the curved surface $S_c$ exceeds the portion $P_h$ on the curved surface $S_c$ during the projection step of the weft yarn Y. Then, the moving resistance of the weft yarn Y begins to decrease immediately before the "free flight" period terminates and accordingly the weft yarn Y does not much receive the moving resistance due to the sliding friction during the "measured flight" period. As a result, the running resistance of the weft yarn Y and the speed of the weft yarn passing through the nozzle 30*a* change as shown in upper and lower graphs of FIG. 12, respectively.

Figure 9:
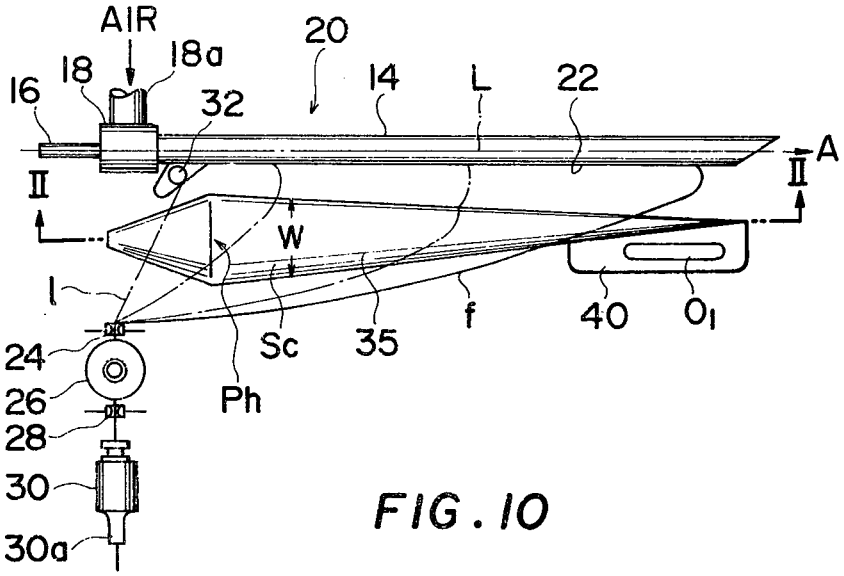
FIG. 9 is a schematic plan view of the essential part of another preferred embodiment of a fluid jet shuttleless loom in accordance with the present invention.
Figure 10:
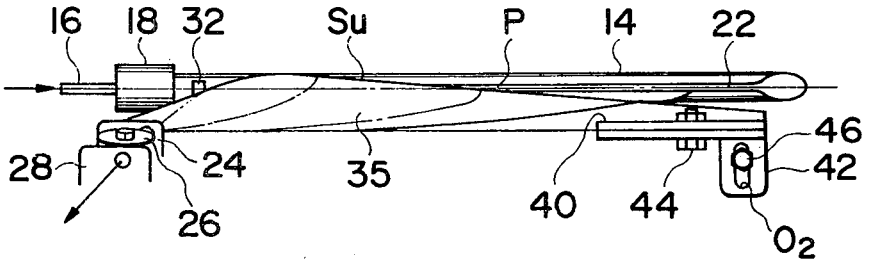
FIG. 10 is a schematic side elevation of the essential part of FIG. 9.
Figure 11:
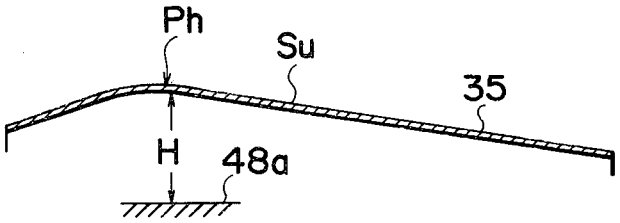
FIG. 11 is a cross-section taken in the direction of the arrows substantially along II—II of FIG. 9.
Figure 12:
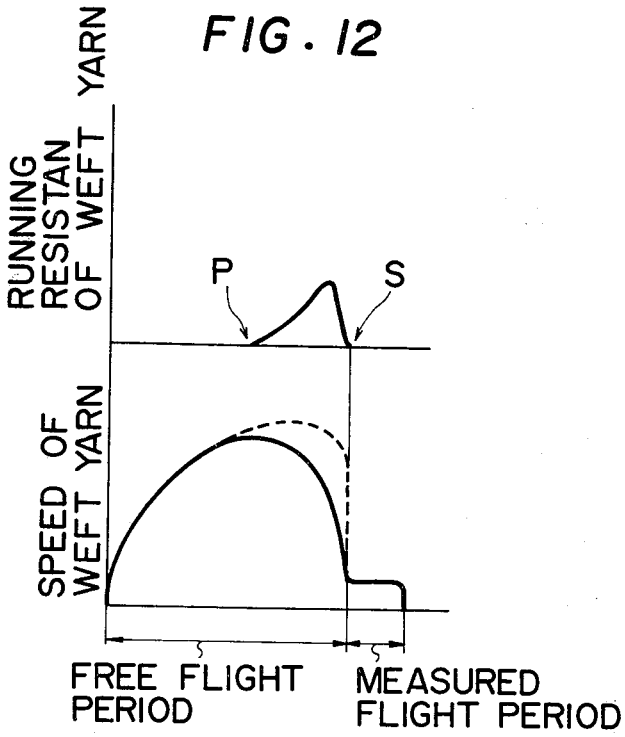
FIG. 12 is a graph similar to the graph of FIG. 8, but showing the characteristics of the weft yarn in the loom of FIG. 9.

By virtue of the above-mentioned arrangement, a so-called "short pick" or incomplete progression of the weft yarn into the shed of the warp yarns is prevented, which "short pick" is liable to occur when the running resistance applied to the weft yarn is too large during the "measured flight" period in which the speed of the weft yarn passing through the nozzle 30*a* is unavoidably low. Also in this embodiment, after one projection of the weft yarn into the shed of the warp yarns is completed, the weft yarn supplied from the measuring roller 10 to the detaining device 20 slidingly moves on the curved surface $S_c$ of the member 35 in the direction of the arrow A and then detained in the state f as shown in FIG. 9. Although the resistance providing member 35 is formed higher at its portion $P_h$, the sliding movement of the weft yarn Y is in the direction of the arrow A is smoothly accomplished by the action of air which is blown off from the slit 22 formed at the side surface of the tubular member 14 of the detaining device 20. It will be understood that the above-mentioned sliding movement of the weft yarn Y is further improved by moving the resistance providing member 35 downwardly when the weft yarn Y is moved in the direction of the arrow A in FIG. 9.

Figure 13:
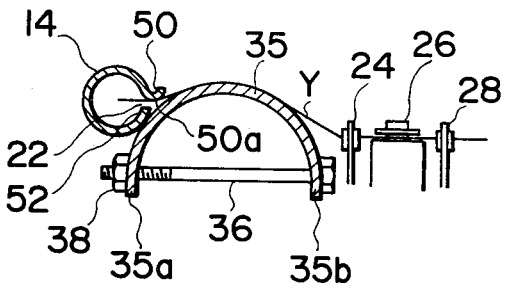
FIG. 13 is a cross-section showing a preferred example of a detaining device of the loom in accordance with the present invention.
Figure 14:
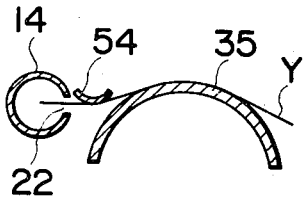
FIG. 14 is a cross-section showing another preferred example of a detaining device of the loom in accordance with the present invention.

FIG. 13 shows a preferred example of the tubular member 14 in which the slit 22 is defined between an upper edge 50 and a low edge 52 which faces to each other. The upper edge 50 is curled upwardly, being formed into the shape of an arc in cross-section. The curled upper edge 50 extends along the length of the slit 22. With this upper edge 50 of the tubular member 14, since the weft yarn Y drawn from the inside of the tubular member 14 contacts the rounded surface 50*a* of the curled upper edge 50, the weft yarn Y is prevented from being damaged due to friction between it and a relatively sharp upper edge. This upper edge 50 is particularly effective in case of using, as the weft yarn Y, a fine thread such as one made of acetate. Alternately, as illustrated in FIG. 14, a guide member 54 may be formed separately from the tubular member 14 in order to obtain the same effect as of the above-mentioned upper edge 50.

In order to attain the characteristic of the running resistance applied to the weft yarn in accordance with the nature of the used thread as the weft yarn, the resistance providing member 35 may be formed by bending a resilient metallic plate using the bolt 36 passing through the both side edge portions 35*a* and 35*b* and the nut 38 into which the bolt 36 is screwed. It is possible in this type of the resistance providing member 35 to change the height of the upper surface of the curved surface $S_c$ thereof by controlling the tightening degree of the nut 38 relative to the bolt 36.

Figure 15:
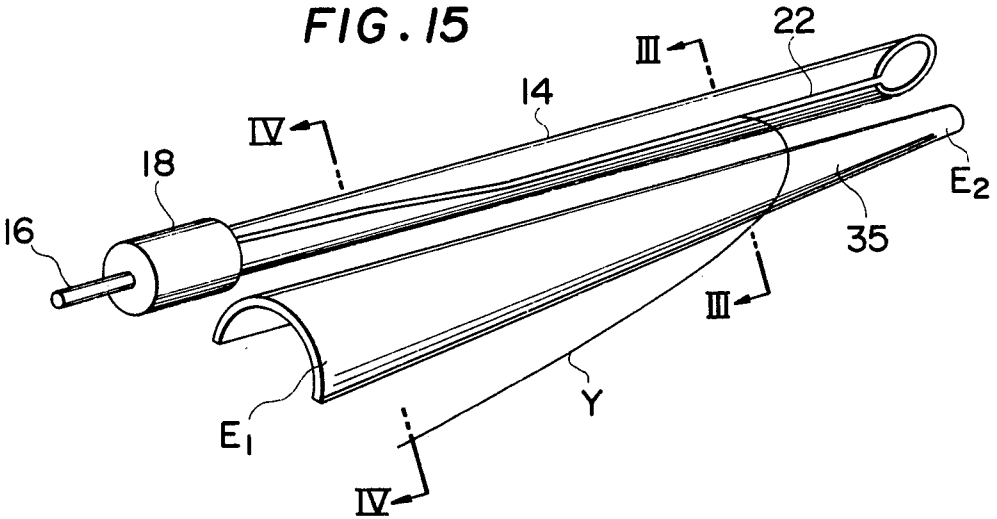
FIG. 15 is a perspective view showing a further preferred example of a detaining device of the loom in accordance with the present invention.
Figure 17:
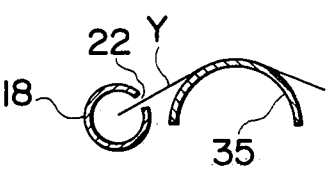
FIGS. 16 and 17 are cross-sections taken in the direction of the arrow substantially along the line III—III and line IV—IV of FIG. 5, respectively.
Figure 16:
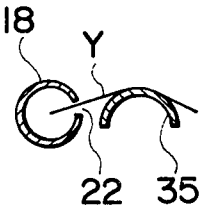

FIGS. 15 to 17 show a preferable example of the tubular member 14 of the detaining device 20, in which the slit 22 is formed generally spirally so that the slit 22 is gradually located upwardly as it approaches to its first end $E_1$. Accordingly, the tubular member 14 in cross-section is changed from the shape shown in FIG. 16 toward the shape shown in FIG. 17 as the slit 22 approaches the first end $E_1$. Also with this arrangement, the friction of the weft yarn Y against the edge of the slit 22 can be considerably decreased and therefore the weft yarn can be prevented from being damaged. It is possible with this arrangement to control the contacting pressure and the contacted length of the weft yarn relative to the curved surface $S_c$ of the resistance providing member 35, i.e., resistance of the weft yarn due to the sliding friction to the curved surface $S_c$ by changing the opening location of the slit 22.

Figure 18:
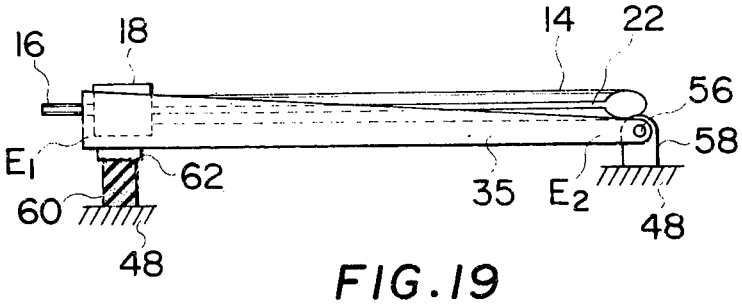
FIG. 18 is a schematic elevational view showing a preferred manner for supporting resistance providing means of the loom in accordance with the present invention.

FIG. 18 shows a preferred example of a manner for supporting the resistance providing member 35, in which the second end portion $E_2$ of the member 34 is pivotally supported on a pin 56 secured to a bracket 58. The first end portion $E_2$ of the member 34 is mounted on an elastomeric member 60 secured to the body 48 of the loom through a base plate 62 secured to the bottom surface of the member 35. With this arrangement, when the weft yarn slidably moved on the curved surface $S_c$ of the member 35 receives an excess tension, the elastomeric member 60 is compressed to deform and accordingly the member 35 moves around the pin 56 anticlockwise. As a result, excess tension applied to the weft yarn is softened, preventing the weft yarn from being cut and damaged.

While the resistance providing member 35 has been shown and described to be formed into the shape of an arc in cross-section to provide the curved surfaces $S_c$ on which the weft yarn Y is slidingly moves, it will be understood that the member 35 may be formed into a flat shape providing a flat surface on which the weft yarn slidingly moves, in which the flat surface is formed so that the moving resistance due to sliding friction of the weft yarn increases as the weft yarn approaches the base member 18 of the detaining device 20. It is preferable to form a plurality of grooves (not shown) on the curved surface $S_c$ of the resistance providing member 35. Moreover, it is also preferable to rough the curved surface $S_c$ of the resistance providing member 35 in order to increase the moving resistance of the weft yarn relative to the curved surface $S_c$. It will be understood that the resistance providing member 35 may be formed of a plurality of rods which are arranged along the longitudinal axis of the resistance providing member 35, by which the resistance providing member 35 may be made more easily.

Figure 19:
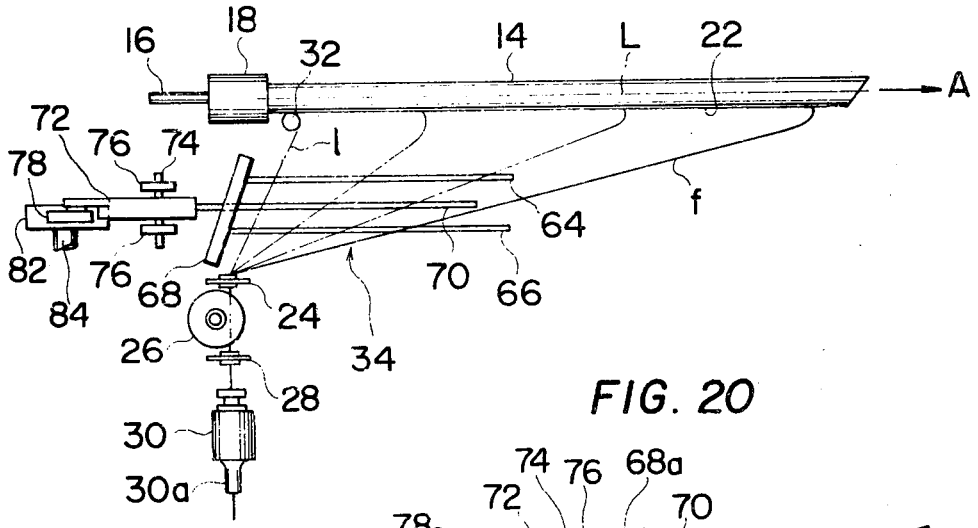
FIG. 19 is a shematic plan view of the essential part of a further preferred embodiment of a fluid jet shuttleless loom in accordance with the present invention.
Figure 20:
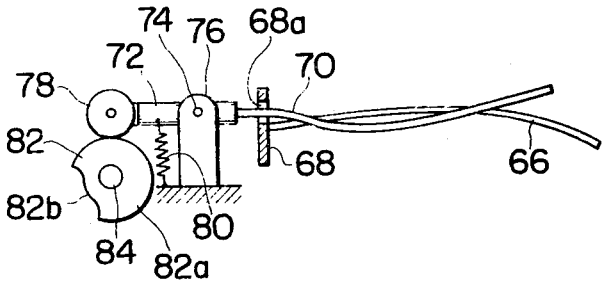
FIG. 20 is an elevational view of the resistance providing means of the loom of FIG. 19.
Figure 21:
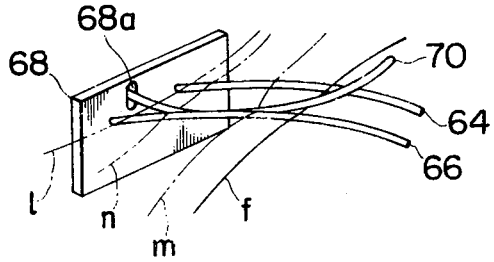
FIG. 21 is a perspective view of the essential part of the resistance providing means of FIG. 20.

FIGS. 19 to 21 illustrate an essential part of a further preferred embodiment of the fluid jet shuttleless loom in accordance with the present invention. In this embodiment, the resistance providing means 34 comprises a pair of fixed rod members 64 and 66 which are fixedly secured to a base plate member 68 and arranged generally parallel with the longitudinal axis L of the tubular member 14 of the detaining device 20. The reference numeral 70 represents a movable rod member which passes through an opening 68*a* formed through the base plate member 68 and fixedly secured to an end of a swingable arm 72. The rod members 64, 66 and 70 are curved as shown in FIG. 21. The swingable arm 72 is pivotally mounted on a pin 74 supported by a pair of brackets 76. The swingable arm 72 is provided with a cam roller or follower 78 which is biased anti-clockwise by the action of a spring 80 to be contacted on the cam surface of a generally circular cam 82. The cam 82 is mounted on a rotatable shaft 84 which is rotated with the operation of the shuttleless loom. The cam 82 is formed at its cam surface with a relatively high altitude portion 82*a* and a relatively low altitude portion 82*b*. The cam 82 is arranged so that when the cam roller 78 contacts the high altitude portion 82*a*, movable rod member 70 crosses the fixed rod members 64 and 66 as viewed from the side of the shuttleless loom as shown in FIG. 20, whereas when the cam roller 78 contacts the low altitude portion 82*b*, the swingable arm 72 is moved anti-clockwise to move the movable rod member 70 upwardly in FIG. 20 to cancel the above-mentioned crossing between the movable rod member 70 and the fixed rod members 64 and 66. Moreover, in this case, the shuttleless loom is arranged so that the cam roller 78 contacts the high altitude portion 82*a* of the cam surface of the cam 82 during "free flight" period, and contacts the low altitude portion 82*b* of the same from the terminal stage of the "measured flight" period to the initial state of the next step at which the weft yarn Y from the measuring roller 10 begins to be detained in the detaining device 20.

With thus arranged shuttleless loom, the weft yarn from the detaining device 20 is passed between the movable rod member 70 and the fixed rod members 64 and 66, being bent and supplied with a running resistance as indicated by the states m and n in FIG. 21. This prevents the sudden decrease in the speed of the weft yarn passing through the nozzle 30*a* of the yarn projecting unit 30 when the "free flight" period. When the "measured flight" period begins, the weft yarn from the detaining device 20 is put into the state l shown in FIG. 21 in which the weft yarn Y is streched between the stop 32 and the guide means 24 and consequently the weft yarn scarcely receive the running resistance from the rod members 64, 66 and 70. From terminal stage of the "measured flight" period to the initial stage of the detaining step, the movable rod member 70 is moved anti-clockwise, cancelling the above-mentioned crossing between the movable rod member 70 and the fixed rod members 64 and 66. As a result, when the weft yarn Y is detained in the detaining device 20 from the state l to the state f shown in FIG. 19 after the projection of the weft yarn Y into the shed of the warp yarns, the weft yarn Y scarcely receive the running resistance and can withdraw from the rod members 64, 66 and 70.

It will be understood from the foregoing, that the above-mentioned resisnace providing means may be, as it is, applied to the arrangement of FIG. 2. Additionally, the resistance providing means of FIGS. 5 to 7, 9 to 11, 13 to 18 may be installed in the tubular member 14" of the detaining device 20 of FIG. 3. In this case, the resistance providing means may be securely formed on the inner surface of the tubular member 14", or slidably formed in which the slidable resistance providing means may be arranged to be fixable by means for fixing the slidable resistance providing means from the outside of the tubular member 14". Additionally, the resistance providing means of FIGS. 19 to 21 may be installed between the outlet 16" and the guide means 24. In this case, it is possible to provide the weft yarn with a considerably high resistance by suitably selecting the shape of the cam surface of the cam 82 so that the movable rod member 70 crosses the fixed rod members 64 and 66 as shown in FIG. 21 in the course of the "free flight" period.

What is claimed is:

1. A fluid jet shuttless loom, comprising:

projecting means for projecting a weft yarn by the action of a fluid jet at a projection step of weft yarn, the projecting step consisting of a "free flight" period and a "measured flight" period of the projected weft yarn, the "measured flight" period following the "free flight" period;

detaining means for detaining a length of the weft yarn before projection from said projecting means, said detaining means including a tubular member in which a part of the length of the weft yarn is movably detained;

grasping means for grasping the weft yarn to stop supply of the weft yarn to said projecting means, said grasping means releasing the weft yarn to supply it to said projecting means at the projection step; and guide means for guiding the weft yarn from the tubular member of said detaining means; and resistance providing means for providing a moving resistance due to sliding friction, to the weft yarn between the tubular member of said detaining means and said guide means, during a period from the "free flight" period until at least the time immediately before the beginning of the "measured flight" period.

2. A fluid jet shuttleless loom, comprising;

projecting means for projecting a weft yarn by the action of a fluid jet at a projection step of weft yarn, the projecting step consisting of a "free flight" period and a "measured flight" period of the projected weft yarn, the "measured flight" period following the "free flight" period;

detaining means for detaining a length of the weft yarn before projection from said projecting means, said detaining means including a tubular member in which a part of the length of the weft yarn is movably detained;

grasping means for grasping the weft yarn to stop supply of the weft yarn to said projecting means, said grasping means releasing the weft yarn to supply it to said projecting means at the projection step; and guide means for guiding the weft yarn from the tubular member of said detaining means; and resistance providing means for providing a moving resistance due to sliding friction, to the weft yarn between the tubular member of said detaining means and said guide means, said resistance providing means including means for increasing the moving resistance of the weft yarn with progress of the projection step during a period from the "free flight" period until at least the time immediately before the beginning of the "measured flight" period.

3. A fluid jet shuttleless loom as claimed in claim 2, in which said resistance providing means further includes means for decreasing the moving resistance of the weft yarn from the initial stage of the "measured flight" period at the latest.

4. A fluid jet shuttleless loom as claimed in claim 3, in which said resistance providing means includes an elongate resistance providing member which is disposed between and spaced apart from the tubular member of said detaining means, said resistance providing member having an elongate curved surface whose longitudinal axis is generally parallel with the longitudinal axis of the tubular member of said detaining means, on which curved surface the weft yarn from the tubular member of said detaining means slidingly moves, the curved surface being formed such that the moving resistance of the weft yarn moving thereon increases with progress of the projection step and decreasing the moving resistance of the weft yarn from the initial stage of the "measured flight" period at the latest.

5. A fluid jet shuttleless loom as claimed in claim 4, further comprising means for controllably securing said resistance providing member to a portion of the body of the shuttleless loom so that the location of said resistance providing member is adjustable relative to the tubular member of said detaining means.

6. A fluid jet shuttleless loom as claimed in claim 5, in which the curved surface of said resistance providing member is bent bendable plate, a bolt passing through the side edge portions of the bendable plate and a nut incorporated with the bolt, the curved surface being controllable by changing the location of the nut relative to the bolt.

7. A fluid jet shuttleless loom as claimed in claim 4, in which the tubular member of said detaining means has an elongate slit located along the longitudinal axis of tubular member and faces to said resistance providing member.

8. A fluid jet shuttleless loom as claimed in claim 7, further comprising means for preventing the weft yarn from contacting with one of two edges defining the slit of the tubular member of said detaining means.

9. A fluid jet shuttleless loom as claimed in claim 8, in which the preventing means includes a curled edge portion having a rounded surface on which the weft yarn is slidingly contactable.

10. A fluid jet shuttleless loom as claimed in claim 8, in which the preventing means includes a guide member disposed between the tubular member of said detaining means and said resistance providing member, said guide member having a rounded surface on which the weft yarn is slidingly contactable and located so that the weft yarn is prevented from contacting with the edges defining the slit of the tubular member.

11. A fluid jet shuttleless loom as claimed in claim 3, in which said resistance providing means includes two fixed rod members fixed to a base member and a movable rod member movable between its first position to be located between the two fixed portion and its second position to be located upwardly and spaced apart relative to the fixed rod members, the weft yarn being passable between the fixed rod members and the movable rod member, the fixed rod members and the movable rod member in its first position being in a relationship in which the moving resistance of the weft yarn increases with progress of the "free flight" period and decreasing during "measured flight" period.

12. A fluid jet shuttleless loom as claimed in claim 11, in which said resistance providing means further includes control means for selectively putting the movable rod member into the first and second positions, said control means including a swingable arm pivotally supported on a pin, the movable rod member being secured to one end of said swingable arm, a cam follower rotatably supported at the other end of said swingable arm, a cam rotatable in accordance with the operation of the shuttleless loom, said cam having a cam surface having a relatively high altitude portion and a relatively low altitude portion, said cam follower being biased to contact with the cam surface by the action of a spring, in which the movable rod member is put into its first position when the cam follower contact the high altitude portion and into its second position when the cam follower contacts the low altitude portion.

13. A fluid jet shuttleless loom as claimed in claim 12, said control means further includes means for locating said cam so that said cam follower begins to contact with the low altitude portion of the cam surface from the terminal stage of the "measured flight" period.

14. A fluid jet shuttleless loom as claimed in claim 2, in which said resistance providing means includes a resistance providing member which is disposed between and spaced apart from the tubular member of said detaining means and said guide means, said resistance providing member having an elongate curved surface whose logitudinal axis is generally parallel with the longitudinal axis of the tubular member of said detaining means, on which curved surface the weft yarn from the tubular member of said detaining means slidingly moves, the curved surface being formed such that the moving resistance of the weft yarn moving thereon increases with progress of the projection step.

15. A fluid jet shuttleless loom as claimed in claim 14, further comprising means for controllably securing said resistance providing member to a portion of the body of the shuttleless loom so that the location of said resistance providing member is adjustable relative to the tubular member of said detaining means.

16. A fluid jet shuttleless loom as claimed in claim 15, in which the curved surface of said resistance providing member comprising a bent a bendable plate, and a bolt passing through the side edge portions of the plate and a nut incorporated with the bolt.

17. A fluid jet shuttleless loom as claimed in claim 14, in which said resistance providing member is pivotally supported at one end thereof on the body of the shuttleless loom and movably supported at the other end thereof on an elastomeric member secured to the body of the shuttleless loom to soften the tension applied to the weft yarn slidably moving on the curved surface of the resistance providing member.

18. A fluid jet shuttleless loom as claimed in claim 14, in which the tubular member of said detaining means has an elongate slit located along the longitudinal axis of the tubular member and faces said resistance providing member.

19. A fluid jet shuttleless loom as claimed in claim 14, in which the tubular member of said detaining means has an elongate slit which is located generally along the longitudinal axis of the tubular member and generally faces said resistance providing member, and location of the slit changing relative to the longitudinal axis of the tubular member to decrease the sliding friction between the weft yarn and the curved surface of the resistance providing member.

* * * * *